US008633836B1

(12) United States Patent
Ball

(10) Patent No.: US 8,633,836 B1
(45) Date of Patent: Jan. 21, 2014

(54) VEHICLE LOCATOR

(76) Inventor: Lavonnia Ball, Frisco, TX (US)

( * ) Notice: Subject to any disclaimer, the term of this patent is extended or adjusted under 35 U.S.C. 154(b) by 792 days.

(21) Appl. No.: 12/684,918

(22) Filed: Jan. 9, 2010

Related U.S. Application Data

(60) Provisional application No. 61/145,182, filed on Jan. 16, 2009.

(51) Int. Cl.
*G08G 1/123* (2006.01)

(52) U.S. Cl.
USPC . 340/988; 340/989; 340/426.13; 340/426.16; 340/426.28

(58) Field of Classification Search
USPC ..... 340/988, 426.13, 426.12, 426.17, 340/426.18, 426.28, 426.36, 989, 426.16
See application file for complete search history.

(56) References Cited

U.S. PATENT DOCUMENTS

| | | | | |
|---|---|---|---|---|
| 4,797,671 | A * | 1/1989 | Toal, Jr. | 340/8.1 |
| 4,940,964 | A * | 7/1990 | Dao | 340/438 |
| 5,495,357 | A * | 2/1996 | Osterhout | 398/107 |
| 5,630,206 | A * | 5/1997 | Urban et al. | 455/456.1 |
| 5,900,823 | A * | 5/1999 | Coll-Cuchi | 340/5.64 |
| 5,905,432 | A * | 5/1999 | Greene | 340/426.13 |
| 5,940,007 | A * | 8/1999 | Brinkmeyer et al. | 340/12.29 |
| 6,246,314 | B1 | 6/2001 | Djaid | |
| 6,587,052 | B1 * | 7/2003 | Flick | 340/12.55 |
| 7,026,957 | B2 * | 4/2006 | Rubenstein | 340/988 |
| 7,119,679 | B1 * | 10/2006 | Crom | 340/539.32 |
| 7,257,426 | B1 * | 8/2007 | Witkowski et al. | 455/569.2 |
| 7,301,442 | B2 * | 11/2007 | Kolpasky et al. | 340/426.13 |
| 7,369,061 | B1 | 5/2008 | Sellers | |
| 7,411,518 | B2 * | 8/2008 | Ratnakar | 340/932.2 |
| 7,504,931 | B2 * | 3/2009 | Nguyen | 340/426.36 |
| 7,834,758 | B2 * | 11/2010 | Peterson et al. | 340/539.11 |
| 2004/0017293 | A1 * | 1/2004 | Webster | 340/539.32 |
| 2004/0119580 | A1 * | 6/2004 | Spielman et al. | 340/5.52 |
| 2004/0145491 | A1 * | 7/2004 | Nascimento | 340/825.72 |
| 2004/0204159 | A1 * | 10/2004 | Van Bosch | 455/569.1 |
| 2004/0212478 | A1 * | 10/2004 | Kutsuzawa et al. | 340/5.6 |
| 2005/0099275 | A1 * | 5/2005 | Kamdar et al. | 340/426.18 |
| 2005/0277440 | A1 * | 12/2005 | Van Bosch et al. | 455/557 |
| 2006/0025085 | A1 * | 2/2006 | Van Bosch et al. | 455/99 |
| 2006/0049922 | A1 * | 3/2006 | Kolpasky et al. | 340/426.13 |
| 2006/0080030 | A1 * | 4/2006 | Okude et al. | 701/208 |
| 2006/0092002 | A1 * | 5/2006 | Finkelstein | 340/426.19 |
| 2006/0103542 | A1 * | 5/2006 | Ratnakar | 340/692 |
| 2006/0220806 | A1 * | 10/2006 | Nguyen | 340/426.36 |
| 2007/0030121 | A1 * | 2/2007 | Soliz | 340/5.72 |
| 2007/0285230 | A1 | 12/2007 | Anglin | |
| 2007/0296543 | A1 * | 12/2007 | Kashima | 340/5.1 |
| 2008/0055050 | A1 * | 3/2008 | Brown | 340/10.41 |
| 2008/0231433 | A1 * | 9/2008 | McBride et al. | 340/426.17 |

(Continued)

*Primary Examiner* — Hoi Lau
(74) *Attorney, Agent, or Firm* — Kenneth L Tolar

(57) ABSTRACT

A vehicle locator includes a base unit mounted within a vehicle including a wireless, radio frequency (RF) receiver, a microcomputer with flash memory and a speaker. A remote unit having a radio frequency transmitter and a voice transmission means is in wireless communication with the base unit receiver and the associated computer/flash memory. Accordingly, a user can remotely record a desired message onto the microcomputer by simply depressing a record button on the remote unit and speaking into a microphone adjacent thereto. The RF receiver and associated electronics are also electrically connected to the door lock/unlock mechanism that is actuated by the standard keyless vehicle remote. Accordingly, when a vehicle driver remotely locks or unlocks the vehicle doors, the prerecorded message is emitted thereby uniquely identifying the vehicle and allowing the driver to quickly ascertain its location.

6 Claims, 2 Drawing Sheets

(56) References Cited

U.S. PATENT DOCUMENTS

2009/0082928 A1* 3/2009 Witkowski et al. ..... 701/49
2009/0109019 A1* 4/2009 Peterson et al. ..... 340/539.1
2009/0167524 A1* 7/2009 Chesnutt et al. ..... 340/539.19
2009/0212905 A1* 8/2009 Batz et al. ..... 340/5.54
2009/0245562 A1* 10/2009 Saiki et al. ..... 381/345
2009/0273438 A1* 11/2009 Sultan et al. ..... 340/5.7
2010/0141412 A1* 6/2010 Partin et al. ..... 340/426.18

* cited by examiner

VEHICLE LOCATOR

CROSS REFERENCE TO RELATED APPLICATIONS

This application is entitled to the benefit of provisional application No. 61/145,182 filed on Jan. 16, 2009, the specification of which is incorporated herein by reference.

BACKGROUND OF THE INVENTION

The present invention relates to a remotely-activated vehicle locator.

DESCRIPTION OF THE PRIOR ART

Many vehicles include audible alerts that are activated by the keyless remote to notify the driver that the vehicle has been successfully locked or unlocked. The alert also allows a driver to more easily locate the vehicle in a crowded parking lot. However, the alert usually includes either the vehicle horn or a faint beep, both of which are likely to be indistinguishable from those of nearby vehicles. Accordingly, there is currently a need for a device that allows a driver to more easily locate his or her vehicle.

A review of the prior art reveals a myriad of vehicle locating devices. For example, U.S. Pat. No. 7,369,061 issued to Sellers et al. discloses a vehicle locator including a remote unit in wireless communication with a base unit that is mounted on a vehicle roof or another conspicuous location. The base unit includes an electric lamp and a sound emitter that are activated with the remote unit to locate a parked vehicle.

U.S. published patent application no. 20070285230 filed on behalf of Anglin discloses a vehicle locator including a remote that emits voice directions or beeps when approaching a target vehicle.

U.S. Pat. No. 6,587,052 issued to Flick discloses a vehicle remote control having a voice recorder that allows a carrier to record a description of a parked car's location that can be later replayed when attempting to locate the vehicle.

U.S. Pat. No. 7,119,679 issued to Crom discloses a vehicle locating apparatus including a light mounted on the upper end of a vehicle antenna and a sound producer mounted on the vehicle exterior, either of which are selectively activated with a remote unit to assist a driver with locating the vehicle.

U.S. Pat. No. 4,797,671 issued to Toal, Jr. discloses a motor vehicle locator system including a remote unit that activates a vehicle's horn or headlights.

U.S. Pat. No. 6,246,314 issued to Djaid discloses a vehicle locator device including a deployable arm that is secured to a vehicle roof. A remote unit raises the arm to a vertical position and activates audible and visual alarms to assist a driver with locating the vehicle.

Each of the prior art devices described above includes an indistinguishable signal, such as a light, horn or visual indicator for assisting a driver with locating a vehicle. However, because many other vehicles may have similar alert signals, locating the vehicle in a crowded area may be difficult. Furthermore, none of the conventional locators allow a user to record a customized audible alarm for easily identifying a vehicle.

The present invention overcomes the disadvantages of the prior art by providing a remote unit that allows a user to remotely record a desired message onto a base unit mounted on the vehicle. Whenever the door locks are actuated by the vehicle's standard keyless remote, the customized, prerecorded message is replayed allowing the remote carrier to immediately identify his or her vehicle.

SUMMARY OF THE INVENTION

The present invention relates to a vehicle locator including a base unit mounted within a vehicle comprising a wireless, radio frequency (RF) receiver, a micro-computer with flash memory and a speaker. A remote unit having a radio frequency transmitter and a voice transmission means is in wireless communication with the base unit receiver and the associated microcomputer/flash memory. Accordingly, a user can remotely record a desired message onto the microcomputer by simply depressing a record button on the remote unit and speaking into a microphone adjacent thereto. The RF receiver and associated electronics are also electrically connected to the door lock/unlock mechanism that is actuated by the standard keyless vehicle remote. Accordingly, when a vehicle driver remotely locks or unlocks the vehicle doors, the prerecorded message is emitted thereby uniquely identifying the vehicle and allowing the driver to quickly ascertain its location.

It is therefore an object of the present invention to provide a device that allows a vehicle driver to more easily locate a vehicle in crowded or congested areas.

It is another object of the present invention to provide a vehicle locator that allows a user to record a desired sound or message for later playback when the door locks are remotely actuated.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
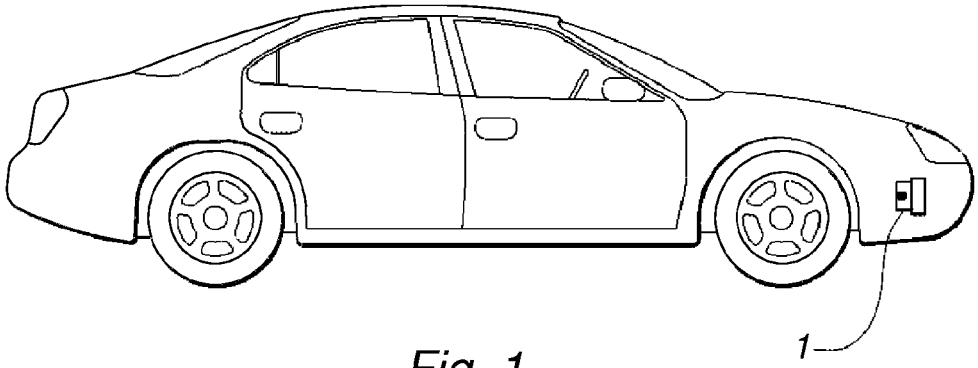
FIG. 1 is a side view of a vehicle depicting the locator according to present invention installed therein.
Figure 2:
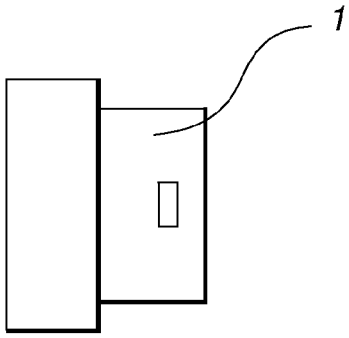
FIG. 2 is an isolated, side view of the base unit.
Figure 3:
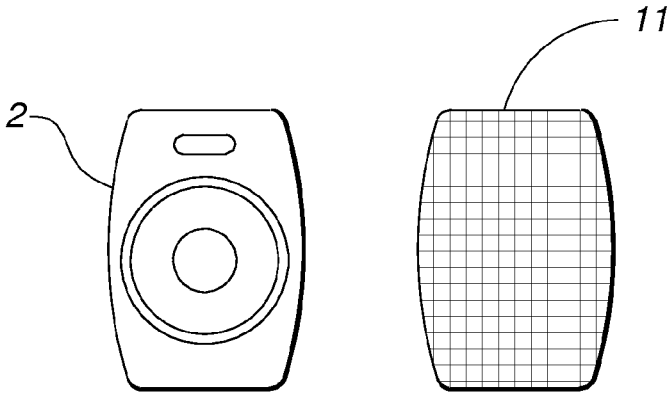
FIG. 3 is a front, plan view of the base unit with the protective speaker screen removed therefrom.
Figure 4:
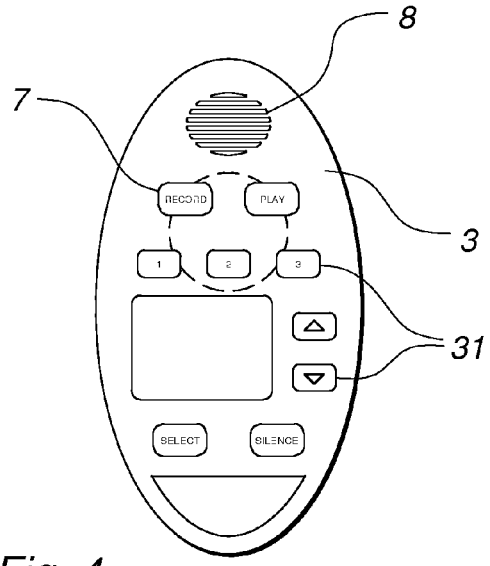
FIG. 4 is a top, plan view of the programming remote unit.
Figure 5:
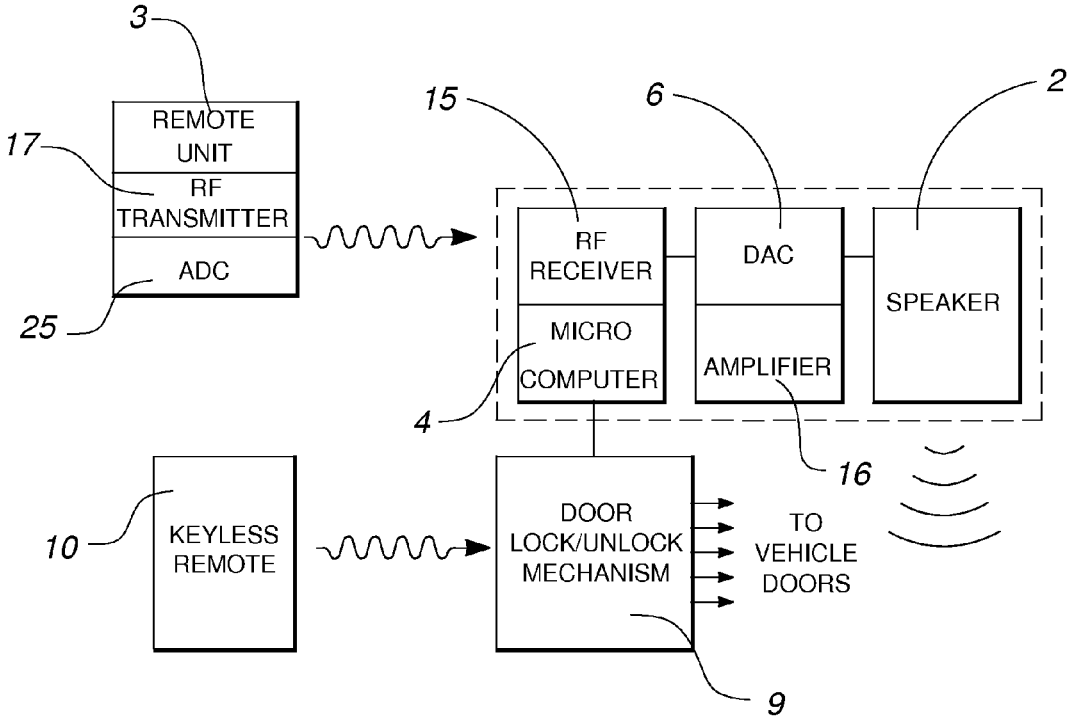
FIG. 5 is a schematic of the various electronic components of the locator.

The present invention relates to a vehicle locator comprising a base unit 1 including a wireless, radio frequency (RF) receiver 15, a microcomputer with flash memory 4, a digital-to-analog converter 6 (DAC), an amplifier 16 and an outdoor speaker 2. Preferably, the speaker is covered with a wire screen 11 and an overlying layer of moisture-impermeable, air-permeable, laminated fabric, such as that marketed under the trademark Gore-Tex™. The base unit is mounted beneath the vehicle's hood, in front of the radiator support and the front fascia.

The locator device also includes a remote unit 3 having a radio frequency transmitter 17 and a voice transmission means in communication therewith. The voice transmission means includes an analog-to-digital converter (ADC) 25 similar to that found in cellular or other wireless phones. When activated, the voice transmission means is in discrete wireless communication with the receiver 15 and the associated computer/flash memory 4. Accordingly, a user can remotely record a desired message onto the microcomputer by simply depressing a record button 7 on the remote unit and speaking into a microphone 8 adjacent thereto.

The RF receiver and associated electronics are also electrically connected to the door lock/unlock mechanism 9 that is actuated by the vehicle's standard keyless remote 10. Accordingly, when a vehicle driver remotely locks or unlocks the vehicle doors, the prerecorded message is emitted thereby uniquely identifying the vehicle and allowing the driver to quickly ascertain its location.

The remote unit includes a plurality of setup buttons 31 that allow the user to program the preferred replay sequence of one or more customized recordings. For example, the user could select a single recording to always be replayed, or dictate that the device randomly scrolls through a plurality of recordings. Furthermore, one recorded message could be associated with the "unlock" command button on the standard keyless remote while a different message could be associated with the "lock" command button. Accordingly, when locking the vehicle, a driver may hear "have a nice day" to further confirm that the vehicle has been locked. When returning and unlocking vehicle, a driver may hear "welcome back" which both confirms that the doors are unlocked and assists the driver with locating the vehicle. In addition, the remote may include a "silence" command button that allows an operator to selectively disable playback of the pertinent recording if the operator wishes to discreetly enter the vehicle. The operator would simply actuate the "silence" button first and then unlock the doors whereby message playback would not occur.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A vehicle locator comprising:

a base unit mounted on a vehicle, said base unit having a speaker and an audio storage medium with audio playback capabilities;

a first remote unit in wireless communication with said storage medium;

means for remotely transmitting a desired customized message from said remote unit to said storage medium and for recording said message thereon, wherein said means for remotely transmitting a desired message from said remote unit to said storage medium and for recording said message thereon includes a microphone on said remote unit; an analog-to-digital converter within said remote unit, said converter in communication with said microphone; a wireless transmitter within said remote unit; said transmitter in communication with said converter; a wireless receiver within said base unit in wireless communication with said transmitter; and a record button on the remote unit in communication with said transmitter and said converter allowing a carrier to project a desired message into said microphone which is wirelessly transmitted to said storage medium;

means for remotely replaying said desired message to locate a parked vehicle, wherein said means for remotely replaying said desired message to locate a parked vehicle includes a remotely-activated vehicle door-locking mechanism for unlocking and locking a vehicle door when receiving a wireless command signal, said door-locking mechanism connected to said storage medium; a digital-to-analog converter in communication with said storage medium and said speaker and a second remote for wirelessly transmitting said command signal to actuate said door-locking mechanism and to replay said desired message.

2. The locator according to claim 1 wherein said speaker is covered with a wire screen and an overlying layer of moisture-impermeable, air-permeable, laminated fabric.

3. The locator according to claim 1 wherein said base unit is mounted beneath a vehicle's hood.

4. The locator according to claim 1 further comprising means for sequentially emitting a plurality of customized recordings in a desired sequence.

5. The locator according to claim 1 further comprising means for emitting a first customized recording when an unlock command on said remotely-activated vehicle door-locking mechanism is actuated, and for emitting a second customized recording when a lock command on said remotely-activated vehicle door locking mechanism is actuated.

6. The locator according to claim 1 further comprising a means for silencing said desired message to allow a vehicle operator to discreetly enter the vehicle.

* * * * *